US011530702B2

(12) United States Patent
Picouet et al.

(10) Patent No.: US 11,530,702 B2
(45) **Date of Patent: *Dec. 20, 2022**

(54) HIGH SUCTION PRESSURE SINGLE SCREW COMPRESSOR WITH THRUST BALANCING LOAD USING SHAFT SEAL PRESSURE AND RELATED METHODS

(71) Applicant: Vilter Manufacturing LLC, Cudahy, WI (US)

(72) Inventors: Jean-Louis Picouet, Waukesha, WI (US); Abhijit Pande, Pune (IN)

(73) Assignee: Vilter Manufacturing LLC, Cudahy, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/412,446

(22) Filed: Aug. 26, 2021

(65) Prior Publication Data

US 2021/0396230 A1 Dec. 23, 2021

Related U.S. Application Data

(63) Continuation of application No. 16/331,909, filed as application No. PCT/US2016/061851 on Nov. 14, 2016, now Pat. No. 11,136,978.

(30) Foreign Application Priority Data

Sep. 16, 2016 (IN) ..... 201621031576

(51) Int. Cl.
*F03C 2/00* (2006.01)
*F03C 4/00* (2006.01)
(Continued)

(52) U.S. Cl.
CPC ..... *F04C 18/52* (2013.01); *F04C 27/009* (2013.01); *F04C 29/0021* (2013.01); *F04C 29/02* (2013.01); *F04C 2240/52* (2013.01)

(58) Field of Classification Search
CPC .... F04C 18/52; F04C 27/009; F04C 29/0021; F04C 29/02; F04C 29/06; F04C 29/065;
(Continued)

(56) References Cited

U.S. PATENT DOCUMENTS 2,984,507 A 5/1961 Welch
3,275,226 A 9/1966 Whitfield
(Continued)

FOREIGN PATENT DOCUMENTS

CN 104838144 8/2015
CN 105805002 7/2016
(Continued)

OTHER PUBLICATIONS

PCT/US2016/061851 International Search Report and Written Opinion of the International Searching Authority dated Jan. 19, 2017 (9 pages).
(Continued)

*Primary Examiner* — Theresa Trieu
(74) *Attorney, Agent, or Firm* — SmithAmundsen LLC

(57) ABSTRACT

A high suction pressure thrust load balance assembly configured for use with a single screw compressor includes comprises a sealing baffle that is keyed to, so as to be rotatable along with, a main rotor drive shaft of the single screw compressor. The sealing baffle is configured to create a force or load to counteract the axial force of the main rotor drive shaft created during rotation of the main rotor drive shaft using the pressurized oil used to lubricate the mechanical shaft seal of the compressor.

10 Claims, 5 Drawing Sheets

(51) Int. Cl.

| | |
|---|---|
| ***F04C 18/00*** | (2006.01) |
| ***F04C 2/00*** | (2006.01) |
| ***F04C 18/52*** | (2006.01) |
| ***F04C 29/02*** | (2006.01) |
| ***F04C 27/00*** | (2006.01) |
| ***F04C 29/00*** | (2006.01) |

(58) Field of Classification Search
CPC ... F04C 29/066; F04C 29/068; F04C 2240/52
See application file for complete search history.

(56) References Cited

U.S. PATENT DOCUMENTS

| | | | |
|---|---|---|---|
| 3,388,854 | A | 6/1968 | Olofsson et al. |
| 3,941,520 | A | 3/1976 | Olofsson |
| 4,610,612 | A | 9/1986 | Kocher |
| 4,610,613 | A | 9/1986 | Szymaszek |
| 4,704,069 | A | 11/1987 | Kocher et al. |
| 4,730,995 | A | 3/1988 | Dewhirst |
| 5,707,223 | A | 1/1998 | Englund et al. |
| 6,186,758 | B1 | 2/2001 | Shaw |
| 7,011,183 | B2 | 3/2006 | Picouet |
| 7,165,947 | B2 | 1/2007 | Hattori et al. |
| 7,618,248 | B2 | 11/2009 | Mosemann et al. |
| 7,891,955 | B2 | 2/2011 | Picouet |
| 8,202,060 | B2 | 6/2012 | Picouet |
| 8,459,969 | B2 | 6/2013 | Matsukuma |
| 8,641,395 | B2 | 2/2014 | Nemit |
| 8,992,195 | B2 | 3/2015 | Hossain et al. |
| 11,136,978 | B2 * | 10/2021 | Picouet ..... F04C 18/52 |
| 2004/0258551 | A1 | 12/2004 | Yoshimura |
| 2008/0240965 | A1 | 10/2008 | Kimura et al. |
| 2014/0322059 | A1 | 10/2014 | Kovacevic et al. |
| 2015/0118092 | A1 | 4/2015 | Takaki et al. |

FOREIGN PATENT DOCUMENTS

| | | |
|---|---|---|
| GB | 1026165 | 4/1966 |
| WO | 2013078132 | 5/2013 |

OTHER PUBLICATIONS

PCT/US2016/061851 International Preliminary Reporton Patentability dated Mar. 19, 2017 (1 page).
First Examination Report from the Indian Patent Office for Application No. 201621031576 dated Aug. 21, 2019 (6 pages).
First Office Action from the State Intellectual Property Office of China for Application No. 2016800892472 dated Sep. 11, 2019 (23 pages).
EP16916387.0 Extended European Search Report dated Apr. 2, 2020 (6 pages).
Second Office Action from the State Intellectual Property Office of China for Application No. 2016800892472 dated May 12, 2020 (11 pages).
First Examination Report from the Canadian Patent Office for Application No. 3,036,672 dated Jun. 8, 2020 (8 pages).
Communication pursuant to Article 94(3) EPC for EU Application No. 16916387.0 dated Aug. 30, 2022 (8 pages).

* cited by examiner

HIGH SUCTION PRESSURE SINGLE SCREW COMPRESSOR WITH THRUST BALANCING LOAD USING SHAFT SEAL PRESSURE AND RELATED METHODS

FIELD OF THE INVENTION

The present invention relates generally to single screw compressors and, in at least one aspect, such compressors when used in an environment or application in which a high suction pressure is created or used. In another aspect, the invention relates to methods of using and/or operating single screw-type compressors in a high suction pressure application or environment.

BACKGROUND OF THE INVENTION

Compressors (e.g., rotary screw gas compressors) are used, for example, in compression systems (e.g., refrigeration systems) to compress refrigerant gas, such as Freon® (or other R-12, R-13B1, R-22, R-502 and R-503 refrigerants), ammonia, natural gas or the like. One type of rotary gas compressor employs a housing in which a shaft is driven by a motor to drive a single main rotor having spiral grooves thereon, and which grooves mesh with a pair of gate or star rotors on opposite sides of the rotor to define gas compression chambers. The housing is provided with two gas suction ports (one near each gate rotor) and with two gas discharge ports (one near each gate rotor). Two dual slide valve assemblies are provided on the housing (one assembly near each gate rotor) and each slide valve assembly comprises a suction (also referred to as a "capacity slide valve") and a discharge slide valve (also referred to as a "volume slide valve") for controlling an associated suction port and an associated discharge port, respectively.

U.S. Pat. Nos. 4,610,612, 4,610,613 and 4,704,069, all of which are assigned to the same assignee as the present application, disclose a dual-slide valve rotary gas compressor of the kind described above. The teachings and disclosures of each of these patents are incorporated by reference in their entireties herein. Electric motors or engines are typically employed to drive rotors in rotary compressors and compressor loading and unloading is accomplished by positioning of slide valves which control admission and discharge of gas into and from the compression chambers.

However, it has been found that, for current single screw-type compressors, particularly when suction pressure is increased substantially so that the compressors operate in high suction pressure applications or environments (e.g., greater than or equal to 300 psi), the axial load on the main shaft also increases. One result or outcome of such high axial load being placed on the main shaft is that bearing life decreases (i.e., due to increased load on the bearings) and, in some instances, decreases dramatically. Single screw compressors must be shut down and taken out of commission for maintenance to replace or repair damaged bearings.

While it may be possible to add bearings, thereby further distributing the load over more components, or making specialty bearings having a higher load tolerance, the bearings will still eventually wear out.

Therefore, it would be desirable to provide an improved single screw compressor that can operate for long periods of time in a high suction pressure environment without the need to replace or repair bearings that are worn or damaged as a result of such high suction pressure and resultant main shaft high axial load.

SUMMARY OF THE INVENTION

In accordance with at least one aspect of the invention, a high suction pressure thrust load balance assembly configured for use with a single screw compressor is provided. The high suction pressure thrust load balance assembly comprises a sealing baffle that is keyed to, so as to be rotatable along with, a main rotor drive shaft of the single screw compressor. The sealing baffle is configured to create a force or load to counteract the axial force of the main rotor drive shaft created during rotation of the main rotor drive shaft using the pressurized oil used to lubricate the mechanical shaft seal of the compressor.

In accordance with at least a further aspect of the invention, a single screw compressor having a high suction pressure load balance assembly is provided. The single screw compressor comprises a housing, a main rotor secured within the housing and rotatably driven by a main rotor drive shaft about a main rotor drive shaft axis. The main rotor is operably engaged with a plurality of gate rotors that are also secured within the housing. The high suction pressure load balance assembly comprises a sealing baffle that is keyed to, so as to be rotatable along with, the main rotor drive shaft. The sealing baffle is configured to create a force or load to counteract an axial force of the main rotor drive shaft created during rotation of the main rotor. Advantageously, the high suction pressure load balance assembly is structured to aid in preventing excessive load to one or more shaft bearings during operation of the compressor under a high input or suction pressure condition (i.e., greater than or equal to 300 psi).

In accordance with at least a further aspect of the invention, a method of operating a single screw compressor in a high input or suction pressure environment is provided. The method comprises providing the single screw compressor and creating a high input or suction pressure condition in which a suction pressure is created and is about greater than or equal to 300 psi. The single screw compressor comprises a housing, a main rotor that is secured within the housing and rotatably driven by a main rotor drive shaft about a main rotor drive shaft axis, and operably engaged with a plurality of gate rotors that are also secured within the housing, and a high suction pressure load balance assembly. The high suction pressure load balance assembly comprises a sealing baffle that is keyed to, so as to be rotatable along with, the main rotor drive shaft.

Various other aspects, objects, features and embodiments of the invention are disclosed with reference to the following specification, including the drawings.

Notwithstanding the above examples, the present invention is intended to encompass a variety of other embodiments including for example other embodiments as are described in further detail below as well as other embodiments that are within the scope of the claims set forth herein.

BRIEF DESCRIPTION OF THE DRAWINGS

Embodiments of the disclosure are disclosed with reference to the accompanying drawings and are for illustrative purposes only. The disclosure is not limited in its application to the details of construction or the arrangement of the components illustrated in the drawings. The disclosure is capable of other embodiments or of being practiced or carried out in other various ways. Like reference numerals are used to indicate like components. In the drawings.

DETAILED DESCRIPTION

Figure 1:
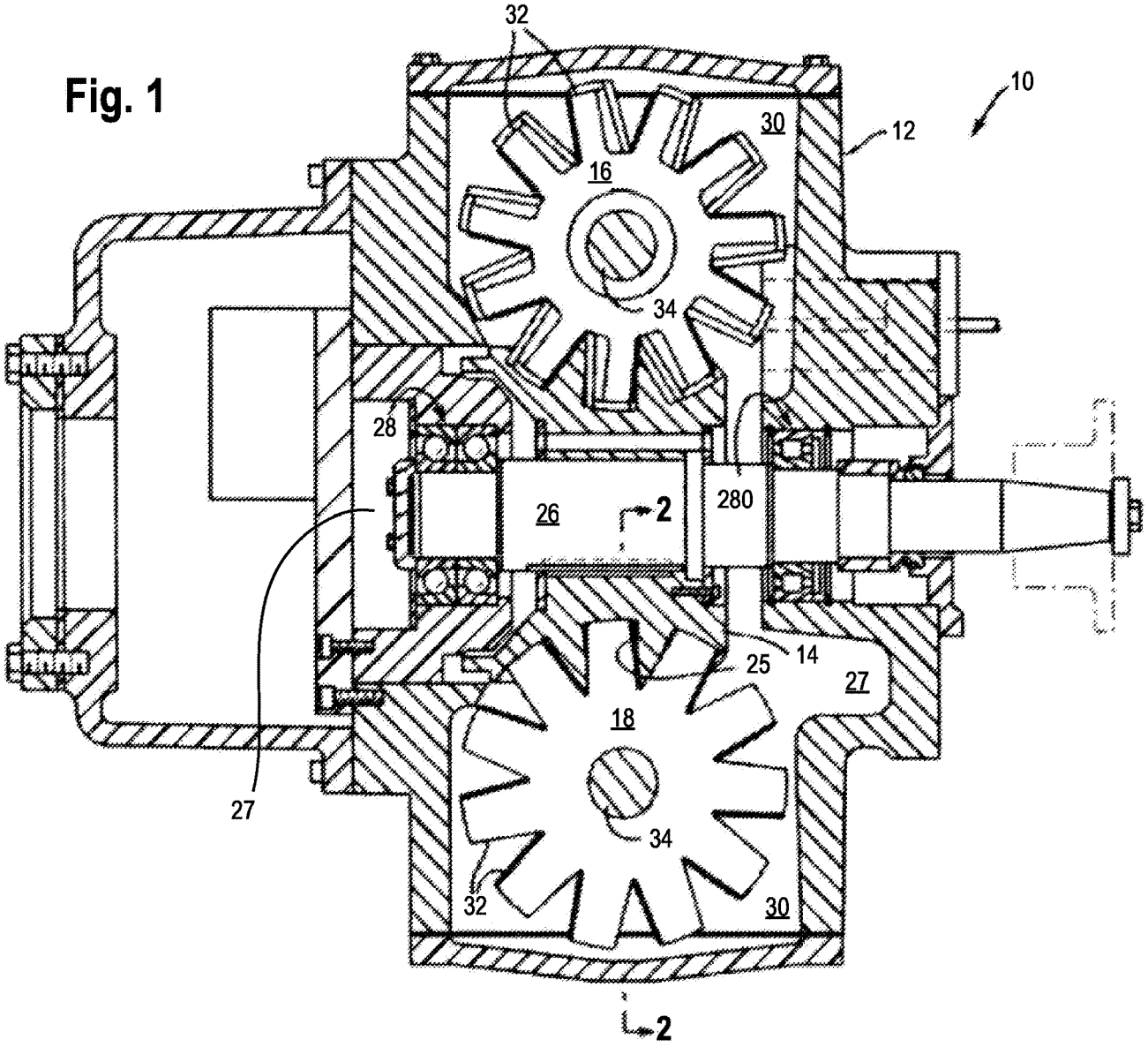
FIG. 1 is a top view, partly in cross-section and with portions broken away, of an exemplary rotary gas compressor employing a single screw rotor, a pair of star or gate rotors and having dual slide valves (not visible), in accordance with embodiments of the present disclosure.
Figure 2:
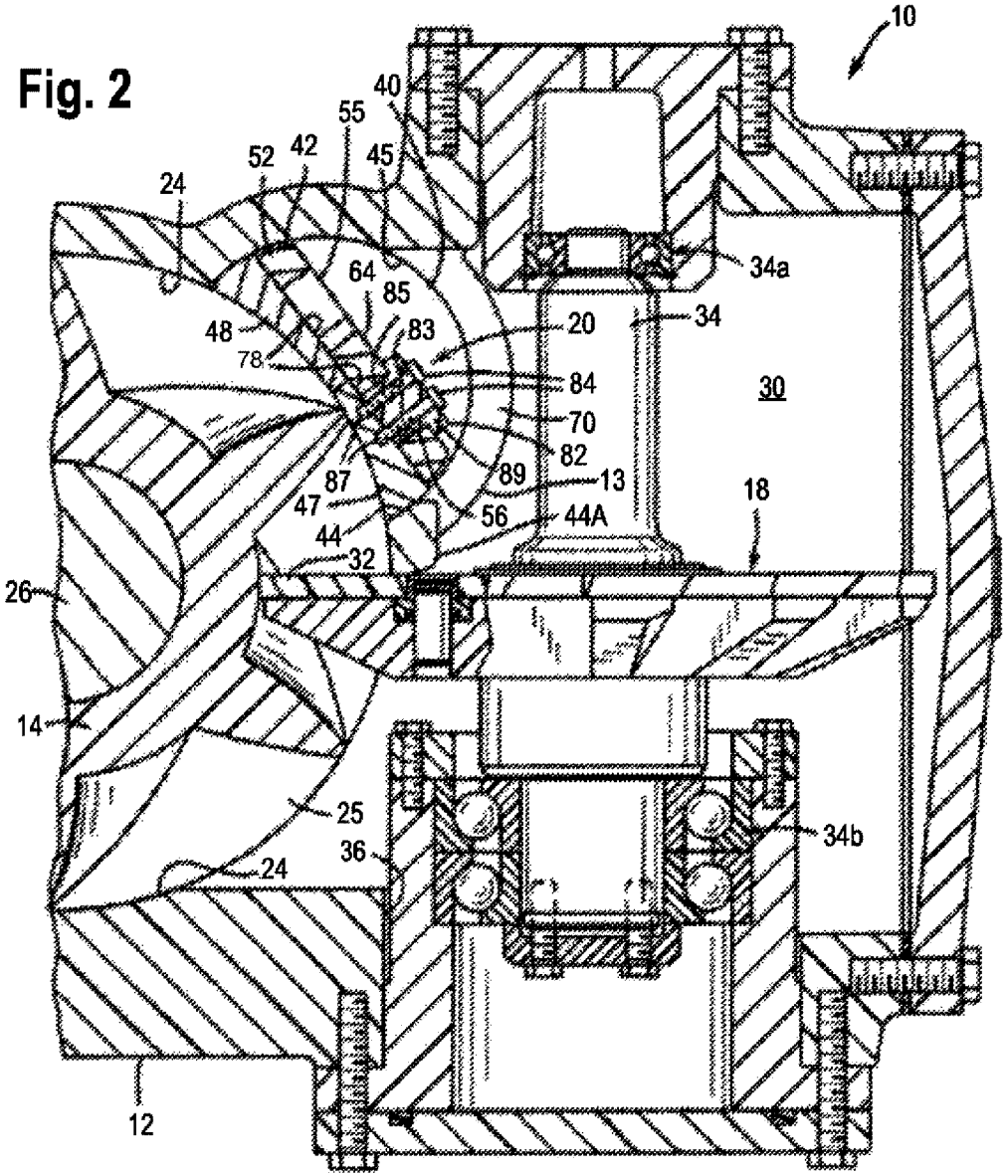
FIG. 2 is an enlarged cross-sectional view taken along line 2-2 of FIG. 1 and showing one set of dual slide valves in cross-section.

Referring to FIGS. 1 and 2, numeral 10 designates an exemplary embodiment of a single screw rotary gas compressor adapted for use in a compression system, such as a refrigeration system (not shown), or the like. Compressor 10 generally comprises a compressor housing 12, a single main rotor 14 mounted for rotation in housing 12, and a pair of star-shaped gate or star rotors 16 and 18 mounted for rotation in housing 12 and engaged with main rotor 14. Compressor 10 further includes two sets of dual slide valve assemblies 20 and 22 (only slide valve assembly 20 is shown in FIG. 1) mounted in housing 12 and cooperable with main rotor 14 to control gas flow into and from the compression chambers on the main rotor 14.

Compressor housing 12 includes a cylindrical bore 24 in which main rotor 14 is rotatably mounted. Bore 24 is open at its suction end 27 (see FIG. 1) and is closed by a discharge end wall 29 (not shown). Main rotor 14, which is generally cylindrical and has a plurality of helical grooves 25 formed therein defining compression chambers, is provided with a rotor shaft 26 which is rotatably supported at opposite ends on bearing assemblies 28, 280 mounted on housing 12. In the embodiment shown, bearing assembly 28 comprises two angular ball bearings and bearing assembly 280 comprises a single roller bearing. The rotor shaft 26 drives rotation of the main rotor 14 about a main rotor shaft axis.

Compressor housing 12 includes spaces 30 therein in which the star or gate rotors 16 and 18 are rotatably mounted and the gate rotors 16 and 18 are located on opposite sides (i.e., 180 degrees apart) of main rotor 14. Each of the star rotors 16 and 18 has a plurality of gear teeth 32 and is provided with a rotor shaft 34 which is rotatably supported at opposite ends on bearing assemblies 34A and 34B (FIG. 2) mounted on housing 12. Each of the star rotors 16 and 18 rotate on an axis which is perpendicular to and spaced from the axis of rotation of main rotor 14. Each tooth 32 of each of the star rotors 16 and 18 successively engages a groove 25 in main rotor 14 as the latter is rotatably driven by a motor (not shown) and, in cooperation with the wall of bore 24 and specifically its end wall 29 (not shown), defines a gas compression chamber.

The two sets of dual slide valve assemblies 20 and 22 (only slide valve assembly 20 is shown in FIG. 1) are located on opposite sides (i.e., 180 degrees apart) of main rotor 14 and are arranged so that they are above and below (with respect to FIG. 2) their associated star rotors 16 and 18, respectively. Since the assemblies 20 and 22 are identical to each other, except as to location and the fact that they are mirror images of each other, only assembly 20 is hereinafter described in detail.

With reference to FIGS. 1 and 2, dual slide valve assembly 20 is located in an opening 40 which is formed in a housing wall 13 of housing 12 defining cylindrical bore 24. Opening 40 extends for the length of bore 24 and is open at both ends. Opening 40 is bounded along one edge by a member 44A, having a smooth surface 44 and a curved cross-sectional configuration. Opening 40 is further bounded on its inside by two axially spaced apart curved lands 45 and 49 (not shown). The space between the lands 45 and 49 (not shown) is a gas inlet passage 70. Opening 40 is at its discharge end and defines a gas port as hereinafter explained. Assembly 20 comprises a slide valve carriage 42 which is rigidly mounted in opening 40 and further comprises two movable slide valve members or mechanisms, namely, a volume slide valve member 48 and a capacity slide valve member 47. Slide valve members 47 and 48 are slidably mounted on carriage 42 for movement in directions parallel to the axis of main rotor 14. In at least some embodiments, slide valve member 47 can comprise a capacity and volume capability and thus can be termed a "dual purpose" slide valve member. (See, for examples, U.S. Pat. Nos. 4,610,613, 4,704,069, 4,610,612, 7,891,955, and 8,202,060, each of which is hereby incorporated by reference in its entirety.)

Still referring to FIGS. 1 and 2, rear surface 71 (not shown) confronts and slides upon front side 53 (not shown) of plate portion 52 of carriage 42. Front surface 72 (not shown) confronts the cylindrical surface of main rotor 14. The inside edges 74 (not shown) of the slide valve members 47 and 48 slidably engage each other. The outside edges 76 (not shown) of the slide valve members 47 and 48 confront and slidably engage the curved surfaces 44 adjacent opening 40 in bore 24. The slide valve members 47 and 48 are slidably secured to carriage 42 by clamping members 81 (not shown) and 82, respectively, which are secured to the slide valve members by screws 84 (two of which are illustrated in FIG. 2). The clamping members 81 (not shown) and 82 have shank portions 85 and 86 (not shown), respectively, which extend through the openings defined by numeral s/surfaces 56 and 57 (not shown), respectively, in carriage 42 and abut the rear surfaces 78 of the slide valve members 47 and 48, respectively. The screws 84 extend through holes 83 in the clamping members 81 (not shown) and 82 and screw into threaded holes 87 in the rear of the slide valve members 47 and 48.

In an embodiment, the slide valves are configured and function as described in U.S. Pat. No. 8,202,060, entitled Compressor Having a High Pressure Slide Valve Assembly.

Figure 3:
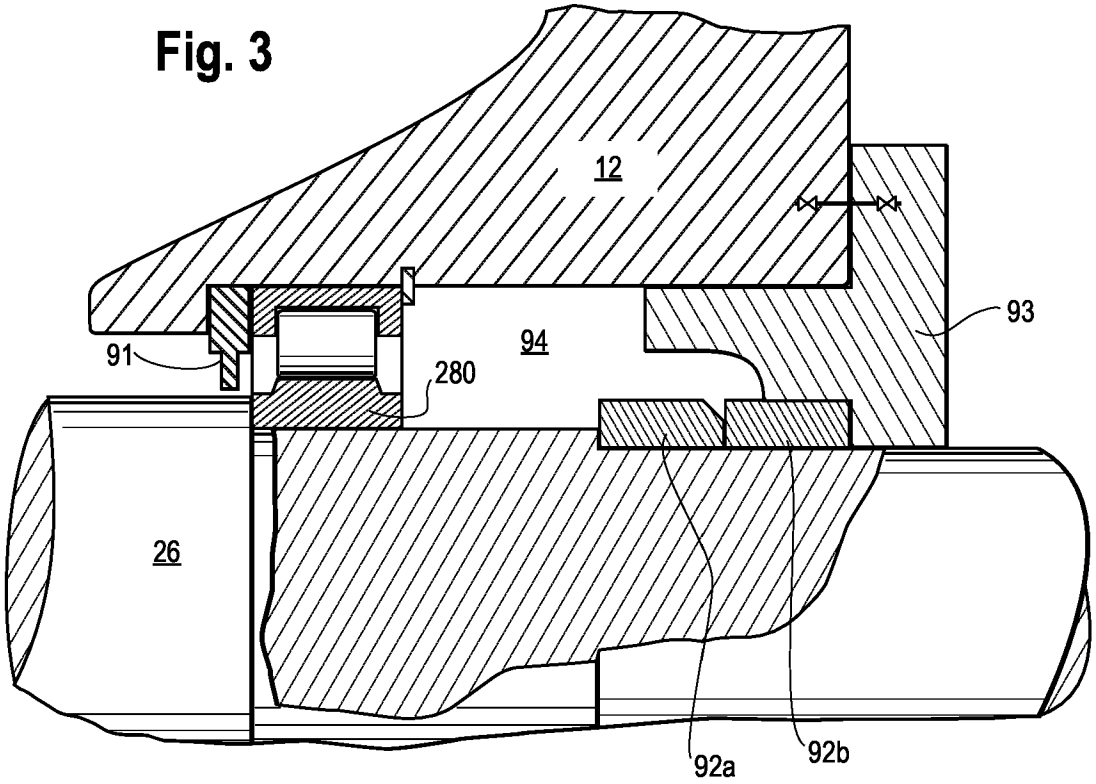
FIG. 3 is a schematic illustration of a portion of the single screw compressor of FIG. 1.

FIG. 3 illustrates a portion of the single screw compressor of FIG. 1 around the roller bearing 280 and showing the seal pressure cavity 94, first and second seals 92*a*, 92*b*, and baffle 91. As illustrated in FIG. 3, the seal pressure cavity 94 is a space between the main housing 12 and main shaft 26 which is contained by the roller bearing 280, seals 92*a*, 92*b* and seal housing 93.

The seals 92*a*, 92*b* prevent leakage of fluid (e.g., gas) from around the point where the rotor shaft 26 extends through the housing 12. In an embodiment, the seals 92*a*, 92*b* are structured and positioned as known in the art to work with a sealing fluid, such as oil. Particularly, in such embodiments and as shown in FIG. 3, seal 92*a* is configured to rotate with the main shaft 26, while seal 92*b* is a stationary seal. Oil, or any other suitable sealing fluid is introduced to the seal pressure cavity 94 to lubricate the roller bearing 280. The sealing fluid (e.g., oil) is under pressure in order to be forced into the bearing cavities of the roller bearing 280. Typically this pressure is differential pressure, although a pump may be used in some embodiments.

During compressor operation, a suction pressure is provided. The suction pressure draws the fluid (e.g., gas) in to the main rotor 14. As the suction pressure increases, it creates a thrust load or force that pushes the main rotor drive shaft longitudinally and axially outwardly away from the gate rotors 16, 18. This increased suction pressure increases the load on bearing assembly 28 and, in some cases, may cause premature or increase wear/load on the bearings of the bearing assembly 28. When operating at low suction pressure (e.g., less than 300 psi), the baffle 91 disrupts the flow of fluid (e.g., gas) along the shaft 26 and creates no load since the baffle 91 is fixed and attached to the housing 12. Additional cancelling forces are required when the compressor 10 operates at higher pressures (e.g., greater than or equal to 300 psi, greater than or equal to 500 psi, or from greater than 300 psi to 800 psi).

When operating at higher pressures, a high suction pressure load balance assembly 90 may be used to balance the longitudinal and axial outward force and reduce load of the bearing assembly 28.

Figure 4:
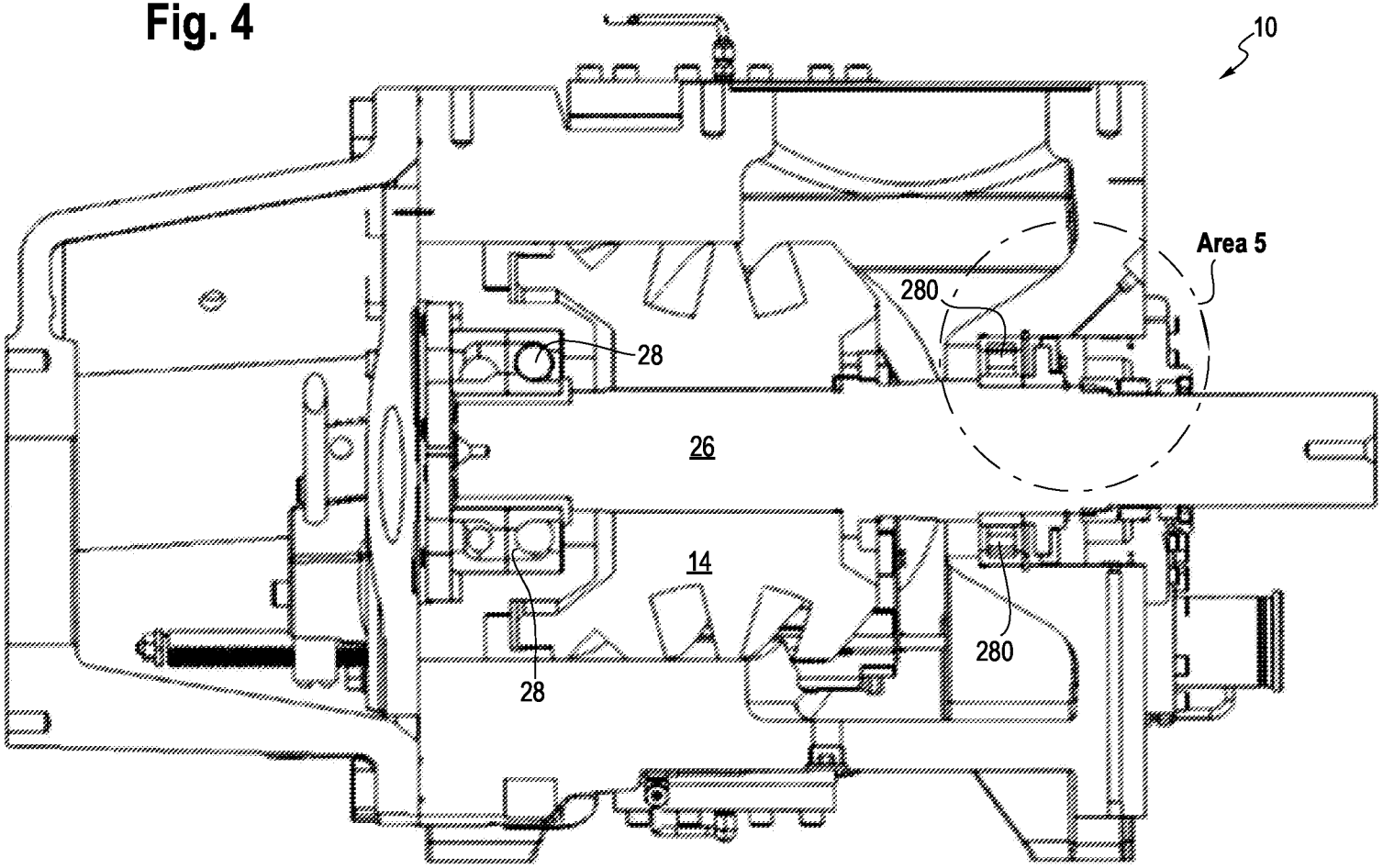
FIG. 4 is a schematic illustration or the single screw compressor of FIG. 1, but modified to include a high suction pressure load balance assembly, in accordance with embodiments of the present disclosure.
Figure 5:
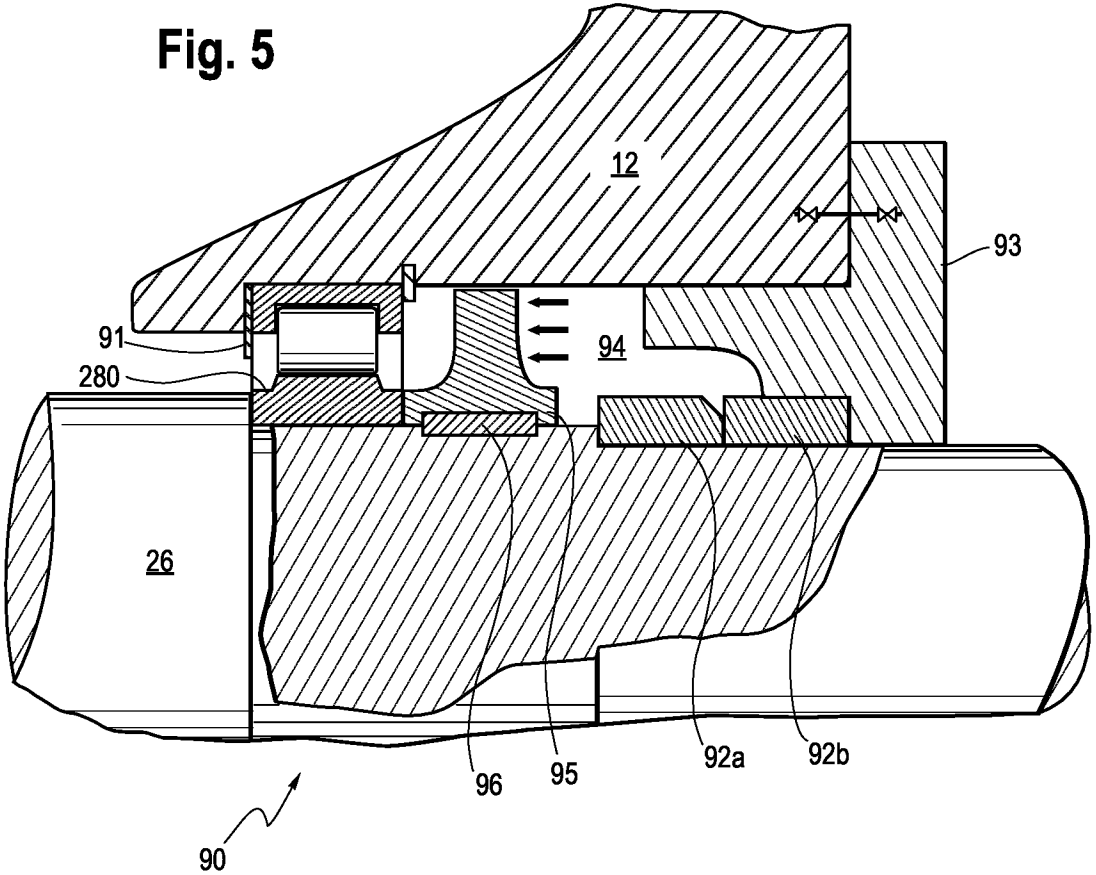
FIG. 5 is a schematic illustration of a portion of the single screw compressor of FIG. 4 which shows the high suction pressure load balance assembly in further detail, in accordance with embodiments of the present disclosure.

FIGS. 4 and 5 illustrate, in accordance with embodiments of the present disclosure, a single screw compressor similar to that shown in FIG. 3, but modified to include a high suction pressure load balance assembly 90. As described in further detail below, the high suction pressure load balance assembly 90 uses the oil pressure in the seal pressure cavity 94 created during operation of the compressor 10 to create a force the counters the thrust pressure on the shaft 26.

As will be understood, the high suction pressure load balance assembly 90 includes structures which are similar to or identical (in design or function) to those discussed with respect to FIG. 3, with like parts/components labeled with like numbers. As shown, the high suction pressure load balance assembly 90 comprises the roller bearing 280, the baffle 91, the pair of seals 92*a*, 92*b*, the seal housing 93, the seal pressure cavity 94, and a sealing baffle 95 positioned between the roller bearing 280 and the shaft seals 92*a*, 92*b*. In other words, the sealing baffle 95 extends into the seal pressure cavity 94 and is adjacent to the roller bearing 280. In the embodiment shown, the baffle 91 is also adjacent the roller bearing 280, but opposite the sealing baffle 95. The baffle 91 is not on the side of the roller bearing 280 exposed to the seal pressure cavity 94.

Particularly to note with respect to FIGS. 4 and 5, the high suction pressure load balance assembly 90 includes the sealing baffle 95. The sealing baffle 95 rotates with the main shaft 26 via or by means of a keyed joint 96 positioned between the main shaft 26 (particularly along its outside surface or diameter) and sealing baffle 95 (particularly along an inside surface or diameter).

Figure 6A:
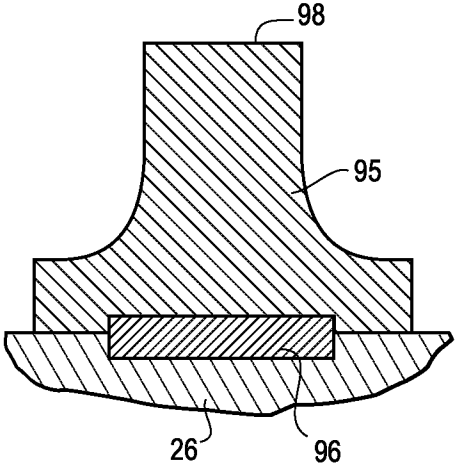
FIG. 6A is an enlarged view of the sealing baffle from FIGS. 4 and 5 which shows the outer surface of the sealing baffle in further detail, in accordance with embodiments of the present disclosure.
Figure 6B:
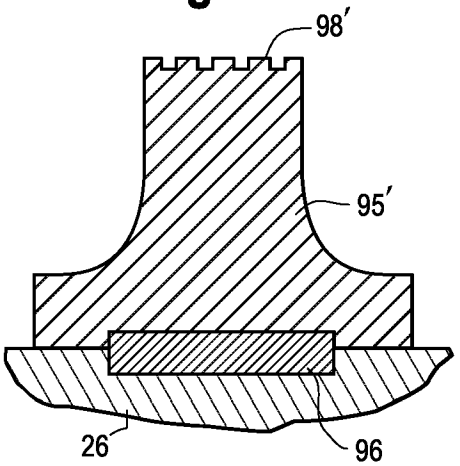
FIG. 6B is an enlarged view of the sealing baffle from FIGS. 4 and 5 which shows an alternative outer surface of the sealing baffle in further detail, in accordance with embodiments of the present disclosure.

In the embodiment shown, the sealing baffle 95 moves with the shaft 26 when it rotates, meaning there is no gap between the sealing baffle 95 and the shaft 26 and no additional seals are therefore required. The sealing baffle 95 approaches but does not touch the inner surface of the main housing 12. Oil is therefore allowed to pass from the seal pressure cavity 94 to the roller bearing 280. As shown in FIG. 6A, the outer surface 98 of the sealing baffle 95 may be smooth and/or have a smooth contour matching the contour of the inner surface of the main housing 12. In other embodiments, as shown in FIG. 6B, the outer surface 98' of the sealing baffle 95' may contain one or more grooves to form a labyrinth. In the embodiment shown in FIG. 6B, the outer surface of the sealing baffle 98' includes what appears to be four linear grooves in the at the cross-section shown in FIG. 5. While the outer surface 98' of the sealing baffle 95' may in fact contain four linear grooves, in other embodiments, the grooves may be non-linear so as to create a more true labyrinth. In still further embodiments, the outer surface 98' of the sealing baffle 95', which one skilled in the art will understand is essentially a ring around the shaft 26, may have a single groove which is non-linear so as to create a labyrinth on the outer surface 98' of the sealing baffle 95'.

The labyrinth or other channels/passages on or in the outer surface 98' of the sealing baffle 95' creates additional resistance for oil to pass from one side of the sealing baffle 95' to the other. Including a labyrinth on the surface 98' of the sealing baffle 95' harnesses more of the force in the cavity 94 to counteract the axial shaft force.

The one or more grooves in the outer surface of the sealing baffle 98' may be machined into the outer surface 98' or created in any other suitable method. The grooves may have a smooth or irregular surface.

As the operating pressure of the compressor 10 increase to greater than or equal to 300 psi (e.g., 300 psi to 800 psi, or greater than or equal to 500 psi), the suction pressure creates a thrust load or force that pushes the main rotor drive shaft 26 longitudinally and axially outwardly away from the gate rotors 16, 18. As described earlier, the force advantageously created in the seal pressure cavity 94 counteracts the main axial force of the shaft 26. In the embodiment shown in FIGS. 4 and 5, the sealing baffle 95 receives most of the pressure generated in the seal pressure cavity 94. Because the sealing baffle 95 is securely connected with the main shaft 26, the pressure exerted on the sealing baffle 95 also counteracts the main axial force of the main shaft 26. The sealing baffle 95 is configured to create a force or load to counteract the axial force of the main rotor drive shaft 26 using the pressurized oil used to lubricate the mechanical shaft seal 92*a* of the compressor 10. As a result, the force on the bearing assembly 28 is reduced or eliminated.

As shown particularly in FIG. 5, the sealing baffle 95 is joined to the main shaft 26 so as to rotate with the main shaft 26 via the keyway 96. A keyway is a mechanical joint used to connect a rotating element, in this case the sealing baffle 95, to a shaft, such as the main shaft 26. In the embodiment shown, the shaft 26 is modified to include a groove on its outside surface or diameter called a keyseat. The surface of the sealing baffle 95 which is configured to engage the shaft 26 has a corresponding groove called a keyway. Typically, and particularly when joining a rotating element to a shaft, the keyseat and keyway are parallel with the shaft 26. When the keyseat and keyway are aligned, they form a hollow having a shape defined by the keyseat and keyway. The key used to join the shaft 26 and the sealing baffle 95 is a structural element having a shape corresponding to that hollow formed by the keyseat and keyway.

While other structures, components and assemblies may be used to secure the sealing baffle 95 to the shaft 26 such that the sealing baffle 95 rotates with the shaft 26, one skilled in the art will appreciate that using the keyway 96 permits existing compressors to be retrofit with the high suction pressure load balance assembly 90 without significant impact.

As will further be understood by one skilled in the art, the high suction pressure load balance assembly 90 uses the existing structures and operation of a single screw compressor and is therefore not suitable for use in other types of compressors (e.g., twin screw compressors).

In an embodiment, the present disclosure provides a method of operating a single screw compressor in a high input or suction pressure environment. The single screw compressor may be a compressor according to any one embodiment or combination of embodiments described herein.

In an embodiment, the method of operating a single screw compressor in a high input or suction pressure environment comprises providing the single screw compressor. In an embodiment, the single screw compressor comprises a housing; a main rotor that is secured within the housing and rotatably driven by a main rotor drive shaft about a main rotor drive shaft axis, and operably engaged with a plurality of gate rotors that are also secured within the housing; and a high suction pressure load balance assembly, the assembly comprising a sealing baffle structure that is keyed to, so as to be rotatable along with, the main rotor drive shaft.

In the method of operating a single screw compressor in a high input or suction pressure environment, the method next requires creating a high input or suction pressure condition in which a suction pressure is created. In an embodiment, the high input or suction pressure condition is an operating pressure of about greater than or equal to 300 psi, or about greater than or equal to 500 psi, or from about greater than or equal to 300 psi to about 800 psi.

In an embodiment, the step of creating a high input or suction pressure condition creates a high thrust load on the main rotor.

In an embodiment, the method further comprises the step of using the high pressure suction load balance assembly to balance or counter the thrust load, thereby reducing the net thrust load on the main rotor and, in turn, the bearings (e.g., shaft bearings).

In one exemplary embodiment, in accordance with one or more aspects of the present disclosure, the step of providing the single screw compressor includes providing a single screw compressor further including at least one roller bearing positioned between the housing and the main rotor drive shaft, a seal housing, at least two seals positioned with respect to the seal housing, and a seal pressure cavity defined by the at least one roller bearing, the housing, the seal housing, the at least two seals and the main rotor drive shaft, wherein the seal pressure cavity includes a volume of fluid (e.g., oil or other lubricant). In such an embodiment, the method further includes creating fluid pressure in the seal pressure cavity.

According to embodiments of the present disclosure, the step of using the high pressure suction load balance assembly to balance or counter the thrust load comprises using the fluid pressure in the seal pressure cavity to create a force that balances or counters the thrust load.

It is specifically intended that the present invention not be limited to the embodiments and illustrations contained herein, but include modified forms of those embodiments including portions of the embodiments and combinations of elements of different embodiments as come within the scope of the following claims.

What is claimed is:

1. A high suction pressure thrust load balance assembly configured for use with a single screw compressor, the high suction pressure thrust load balance assembly comprising a sealing baffle that is keyed to, so as to be rotatable along with, a main rotor drive shaft of the single screw compressor, wherein the sealing baffle is configured to create a force or load to counteract an axial force of the main rotor drive shaft created during rotation of the main rotor drive shaft;

wherein the single screw compressor further comprises at least one bearing positioned between the housing and the main rotor drive shaft, a seal housing, at least two seals positioned with respect to the seal housing, and a seal pressure cavity defined by the at least one bearing, the housing, the seal housing, the at least two seals and the main rotor drive shaft, and the sealing baffle projects into the seal pressure cavity.

2. The high suction pressure thrust load balance assembly of claim 1, wherein the high suction pressure thrust load balance assembly is positioned in an area between one or more roller bearings and one or more seals.

3. The high suction pressure thrust load balance assembly of claim 2, wherein the single screw compressor comprises one or more shaft bearings and the high suction pressure load balance assembly is structured to aid in preventing an excessive load on the one or more shaft bearings during an operation of the compressor under a high input or suction pressure condition.

4. The high suction pressure thrust load balance assembly of claim 3, wherein the high input or suction pressure condition is greater than or equal to 300 psi.

5. The high suction pressure thrust load balance assembly of claim 4, wherein the high input or suction pressure condition is from greater than or equal to 300 psi to 800 psi.

6. The high suction pressure thrust load balance assembly of claim 4, wherein the high input or suction pressure condition is greater than or equal to 500 psi.

7. The high suction pressure thrust load balance assembly of claim 1, wherein the sealing baffle is keyed to the main rotor drive shaft using a keyway.

8. The high suction pressure thrust load balance assembly of claim 1, wherein the sealing baffle has an outer surface which is smooth.

9. The high suction pressure thrust load balance assembly of claim 1, wherein the sealing baffle has an outer surface comprising at least one groove.

10. The high suction pressure thrust load balance assembly of claim 1, wherein the sealing baffle is adjacent the at least one bearing.

* * * * *